US006874826B1

(12) United States Patent
Polowinczak et al.

(10) Patent No.: US 6,874,826 B1
(45) Date of Patent: Apr. 5, 2005

(54) ACTUATOR FOR A TILT-LATCH FOR A SASH WINDOW

(75) Inventors: Allen D. Polowinczak, Plainfield, IL (US); Vincent F. Eslick, Chicago, IL (US)

(73) Assignee: Ashland Products, Inc., Lowell, IN (US)

( * ) Notice: Subject to any disclaimer, the term of this patent is extended or adjusted under 35 U.S.C. 154(b) by 411 days.

(21) Appl. No.: 09/713,163

(22) Filed: Nov. 14, 2000

(51) Int. Cl.[7] ..... E05C 1/10

(52) U.S. Cl. ..... 292/175; 292/DIG. 47; 292/163; 292/DIG. 33

(58) Field of Search ..... 292/163, DIG. 47, 292/175, 42, 164, 145, DIG. 33, DIG. 63, 292/DIG. 31; 49/183, 181, 184; 70/89, 90

(56) References Cited

U.S. PATENT DOCUMENTS

| | | | |
|---|---|---|---|
| 16,228 | A | 12/1856 | Copeland |
| 1,781,729 | A | 11/1930 | Major |
| 2,568,273 | A | 9/1951 | Clark |
| 2,965,935 | A | 12/1960 | Olsen |
| 3,080,621 | A | 3/1963 | Mendelsohn |
| 3,122,797 | A | 3/1964 | Segre |
| 3,841,674 | A | 10/1974 | Bisbing et al. |
| 3,850,464 | A | 11/1974 | Bisbing et al. |
| 4,167,835 | A | 9/1979 | Nobes et al. |
| 4,400,026 | A | 8/1983 | Brown, Jr. |
| 4,475,311 | A | 10/1984 | Gibson |
| 4,482,178 | A | 11/1984 | Damiana |
| 4,553,353 | A | 11/1985 | Simpson |
| 4,578,903 | A | 4/1986 | Simpson |
| 4,581,850 | A | 4/1986 | Simpson |
| 4,622,778 | A | 11/1986 | Simpson |
| 4,669,765 | A | 6/1987 | Ullman |
| 4,790,579 | A | 12/1988 | Maxwell et al. |
| 4,791,756 | A | 12/1988 | Simpson |
| 4,824,154 | A | 4/1989 | Simpson |
| 4,837,975 | A | 6/1989 | Simpson |
| 4,901,475 | A | 2/1990 | Simpson |

(Continued)

*Primary Examiner*—John B. Walsh
(74) *Attorney, Agent, or Firm*—Wallenstein Wagner & Rockey, Ltd.

(57) ABSTRACT

A tilt-latch (10) adapted for releasably securing a pivotable sash window (12) disposed within opposed guide rails (16) on a master frame (14) of a window sash assembly (11) is disclosed. The sash window (12) comprises a top sash rail (20), a base (22) and two stiles (24,26) connected together at their extremities. The tilt-latch (10) comprises a housing (42) adapted to be supported by the top rail (20). The housing (42) has an outward end opening (44) and a cover (51). A latch bolt (46) is disposed within the housing (42) and has a nose (47) adapted for engaging a respective one of the guide rails (16). The latch bolt (46) also has a slot (66). The tilt-latch (10) further has an actuator (48) having a post (90). The post (90) is received by the slot (66). The tilt-latch (10) also has a spring (50) for biasing the latch bolt (46) through the outward end opening (44). The actuator (48) is connected to the latch bolt (46) and is sized to be positioned over the entire cover (51) of the housing (42). The housing (42) and latch bolt (46) are made of plastic and the actuator (48) is made from zinc.

51 Claims, 5 Drawing Sheets

U.S. PATENT DOCUMENTS 4,917,413 A 4/1990 Jason et al.
5,028,083 A 7/1991 Mischenko
5,068,932 A 12/1991 Chang
5,096,240 A 3/1992 Schultz
5,121,951 A 6/1992 Harbom et al.
5,121,952 A 6/1992 Jason
5,127,685 A 7/1992 Dallaire et al.
5,139,291 A 8/1992 Schultz
5,145,221 A 9/1992 Pennebaker et al.
5,165,737 A 11/1992 Riegelman
5,465,191 A * 11/1995 Nomura et al. ..... 361/681
5,618,067 A 4/1997 Carlson et al.
5,669,180 A 9/1997 Maier
5,669,639 A 9/1997 Lawrence
5,671,958 A 9/1997 Szapucki et al.
5,806,900 A 9/1998 Bratcher et al.
5,829,196 A 11/1998 Maier
5,927,013 A 7/1999 Slocomb et al.
5,970,656 A 10/1999 Maier
5,996,283 A 12/1999 Maier
6,021,603 A 2/2000 Prete et al.
6,155,615 A 12/2000 Schultz
6,178,696 B1 * 1/2001 Liang ..... 49/185
6,183,024 B1 * 2/2001 Schultz et al. ..... 292/175
6,230,443 B1 * 5/2001 Schultz ..... 49/183
6,340,183 B1 * 1/2002 Ramsauer ..... 292/175

* cited by examiner

ACTUATOR FOR A TILT-LATCH FOR A SASH WINDOW

TECHNICAL FIELD

The present invention relates to a tilt-latch for a pivotal sash window assembly and, more particularly to a tilt-latch actuator adapted to be connected to a latch bolt of the tilt-latch.

BACKGROUND OF THE INVENTION

A pivotal sash window adapted for installation in a master frame of a sash window assembly is well-known. The sash window assembly typically has opposed, vertically extending guide rails to enable vertical reciprocal sliding movement of the sash window in the master frame while cooperatively engaged with the guide rails. The sash window has a top sash rail, a base and a pair of stiles cooperatively connected together at adjacent extremities thereof to form a sash frame, usually a rectangular frame. Typically, a pair of spaced tilt-latches are installed on, or in, opposite ends of the top sash rail.

Each tilt-latch is generally comprised of a housing having an outward end opening and a latch bolt disposed within the housing. A spring disposed within the housing generally biases the latch bolt through the outward end opening to engage the guide rails of the master frame. The latch bolt has an actuator structure to allow for actuation of the latch bolt. The actuator structure is typically a small control button that is connected to the latch bolt. An operator can use his finger to engage the actuator wherein the latch bolt is retracted into the housing. This releases the latch bolt from the guide rail. When the latch bolts of the opposed tilt-latches are actuated simultaneously, the sash window can then be pivoted from the master frame.

A tilt-latch mounted in a top sash rail is typically called a flush-mount tilt-latch. Examples of this type of tilt-latch are shown in U.S. Pat. No. 5,139,291, and application Ser. No. 09/121,289, both assigned to Ashland Products, Inc., the assignee of the present invention, and incorporated by reference and made a part hereof. To accommodate the flush-mount tilt-latch in the top rail, a slot is punched or routed in the top rail.

Pivotal sash window assemblies can be constructed from different materials such as vinyl or wood materials. Tilt-latches and other window hardware components have often been made from plastic using injection molding technology. Such components have also been made from metal materials such as zinc. In a wood window application or simulated wood window application wherein the window assembly has a simulated wood appearance (e.g., wood-style laminate applied over a PVC extrusion), consumers have oftentimes preferred the aesthetic features of metal hardware over plastic hardware. A plastic tilt-latch is just not as aesthetically pleasing in a wood window as a metal tilt-latch. Thus, in wood windows, tilt-latches made from zinc are often used. Zinc tilt-latches, like other metal hardware, are typically more robust that traditional plastic tilt-latches, but also more expensive. In addition, due to the sliding interaction between the metal components of zinc tilt-latches upon actuation, unwanted noise is produced. As a result, consumers sometimes conclude that the zinc tilt-latches, when actuated, do not possess smooth operational characteristics. Expressed differently, the zinc tilt-latches, when actuated, may produce an unwanted metal-on-metal "ringing" sound. Consumers then may question the quality of the tilt-latches due to the unwanted noise produced during actuation. In addition, all zinc tilt-latches include a zinc latch bolt having a nose that is adapted to engage a respective one of the guide rails of the master frame. Because of the hardness of zinc, the latch bolt nose can sometimes damage wood or plastic guide rails when the sash window is pivoted to a closed position where the nose engages an outer portion of the guide rail and moves into the brake shoe channel.

The present invention is provided to solve these and other problems.

SUMMARY OF THE INVENTION

It is an object of the present invention to provide a tilt-latch adapted for releasably securing a pivotable sash window to a master frame of a sash window assembly.

The master frame has opposed, vertically extending guide rails. The sash window has a top sash rail, a base and a pair of stiles cooperatively connected together at adjacent extremities to form a frame. The top sash rail includes a pair of opposing header slots. Each of the header slots forms a pair of opposing, longitudinal header rails.

In accordance with one aspect of the invention, the tilt-latch has a housing adapted to be supported by the top rail. The housing has an outward end opening and a cover. A latch bolt is disposed within the housing and has a nose adapted for engaging a respective one of the guide rails. An actuator is connected to the latch bolt and sized to be positioned over the entire cover.

According to another aspect of the invention, the cover has opposed longitudinal peripheral edges and the actuator has opposed depending longitudinal flanges. The flanges are positioned over the peripheral edges. The flanges slide along the peripheral edges when the latch bolt is retracted into the housing.

According to a further aspect of the invention, the housing is adapted for substantially flush installation in the top rail wherein the cover is positioned on the top rail. The actuator slides along the cover when retracting the latch bolt into the housing exposing a front segment of the cover.

According to yet another aspect of the invention, the latch bolt has a slot and the actuator has a post. The post is received by the slot when the actuator is connected to the latch bolt. In addition, the latch bolt has a finger extending into the slot and the actuator post has a tab. The tab engages an underside of the finger. The actuator further has a pair of ridges depending from an underside of the actuator and extending from the post.

According to a further aspect of the invention, the cover has an underside surface having a recessed portion. The recessed portion accommodates the cover of the housing. In a preferred embodiment of the invention, the cover is rectangular and the recessed portion is also rectangular and corresponds in size to the cover. The cover has a rear transverse edge that engages a rear transverse edge defined by the recessed portion.

According to another aspect of the invention, the actuator has a control button.

According to a further aspect of the invention, the housing is adapted for substantially flush installation in the top rail. The actuator slides along a top surface of the top rail when the latch bolt is retracted into the housing.

According to another aspect of the invention, the actuator is made from metal. In a most preferred embodiment of the invention, the actuator is made from zinc. The housing and latch bolt are preferably made from plastic.

According to another aspect of the invention, the housing and latch bolt have a cooperating mechanism to maintain the latch bolt in a retracted position.

Other features and advantages of the invention will be apparent from the following specification taken in conjunction with the following drawings.

DETAILED DESCRIPTION OF THE INVENTION

Figure 1:
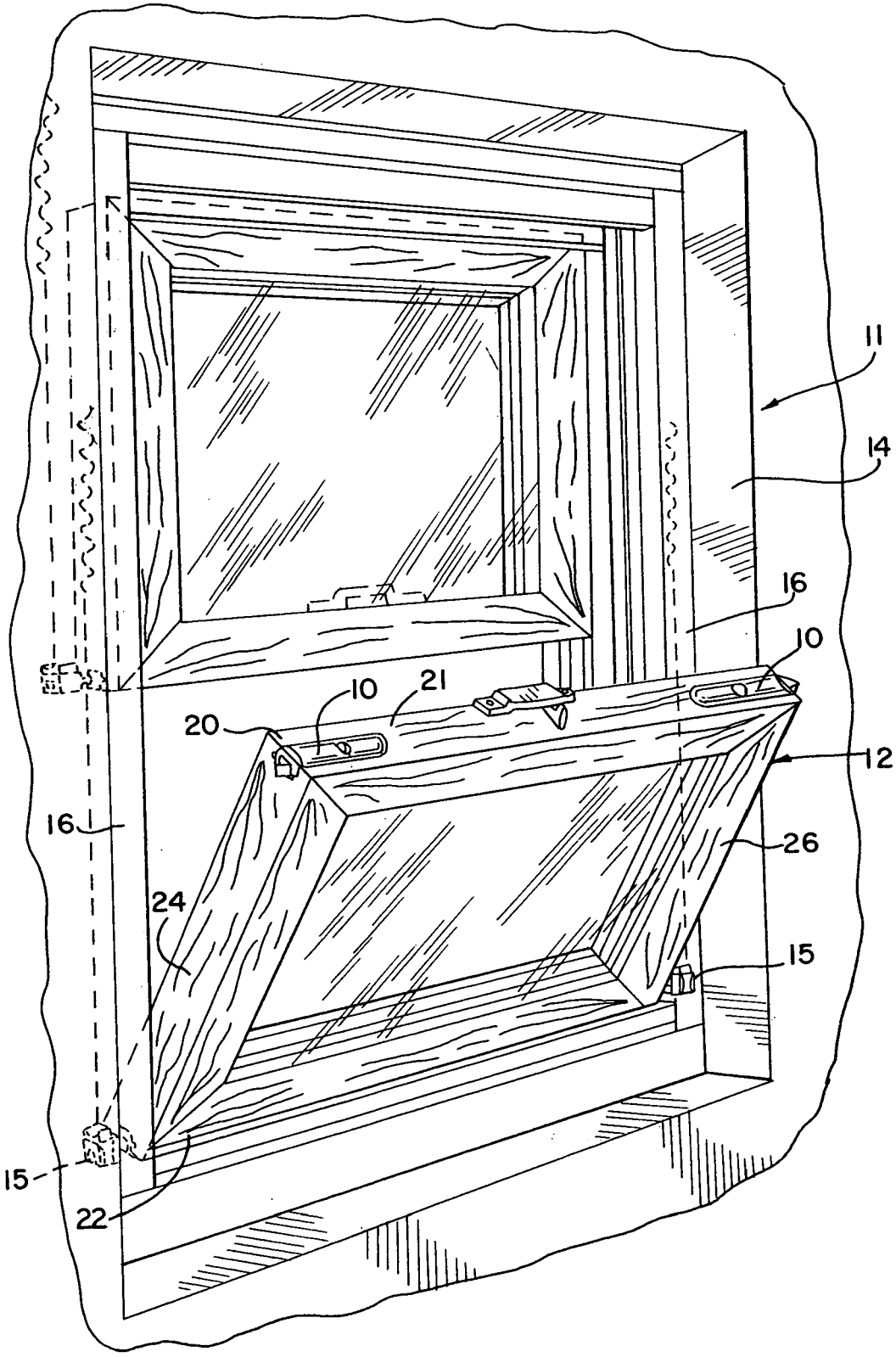
FIG. 1 is a perspective view of a double-hung sash window assembly utilizing tilt-latches each having a tilt-latch actuator according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a tilt-latch of the present invention, generally designated with the reference numeral 10, used in a sash window assembly 11. The sash window assembly 11 shown in FIG. 1 is a double-hung window assembly having a pivotal sash window 12 installed in a master frame 14. The particular sash window assembly 11 shown in FIG. 1 is also made from wood although it could also be made from other materials. The tilt-latch 10 could also be used in all types of pivotal windows or structures. The sash window 12 is pivotally mounted to the master frame 14 by a sash balance/brake shoe assembly 15. As is well known, the master frame 14 has opposed, vertically extending guide rails 16. The sash window 12 has a top sash rail 20 having a top surface 21, a base 22 and a pair of stiles 24,26, cooperatively connected together at adjacent extremities thereof to form a sash frame, typically rectangular although other shapes are possible.

Figure 7:
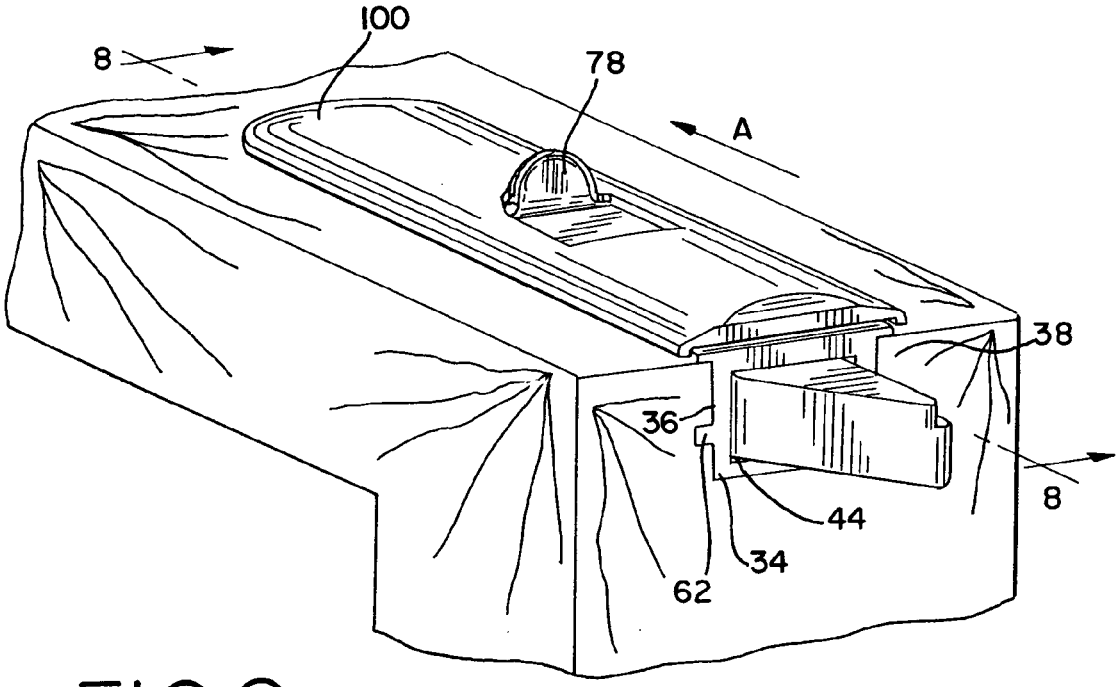
FIG. 7 is a partial perspective view of the tilt-latch installed in a top rail of a sash window.

As discussed, in a most preferred embodiment of the invention, the sash frame is made from solid wood. The sash frame could also be made from simulated wood materials. Other solid structures are also possible such as masonite or pressboard. The sash frame could also be made from extrusions or pulltrusions that are filled with fiberglass, epoxy, plastic, or wood chips. If desired, the sash frame could also be hollow such as when made from PVC extrusions. As shown in FIGS. 1 and 7, the top sash rail 20 includes a pair of opposing header slots 34, which are formed such as by routing the top sash rail 20. The top sash rail 20 could also be punch-routed. In applications where the top sash rail 20 is a hollow extrusion, the header slots 34 may be formed by prepunching the top sash rail 20. Each of the header slots 34 forms a pair of opposing, longitudinal header rails 36,38.

Figure 2:
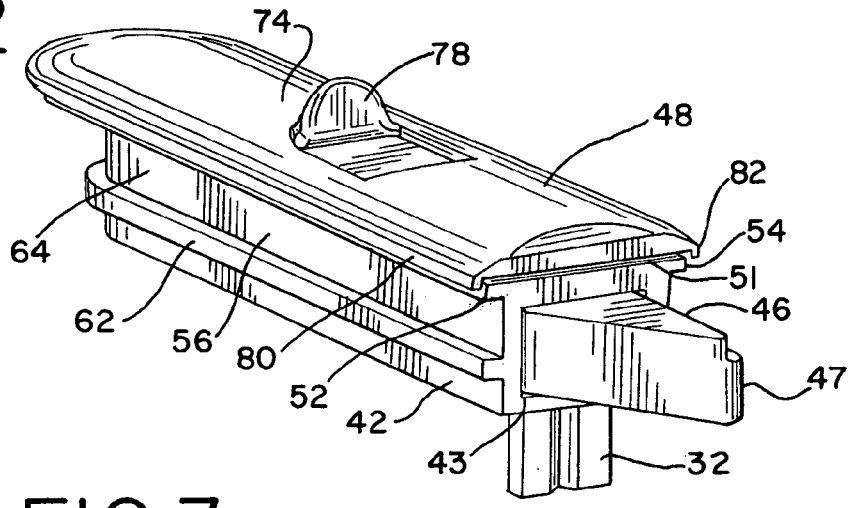
FIG. 2 is a perspective view of the tilt-latch of FIG. 1.
Figure 3:
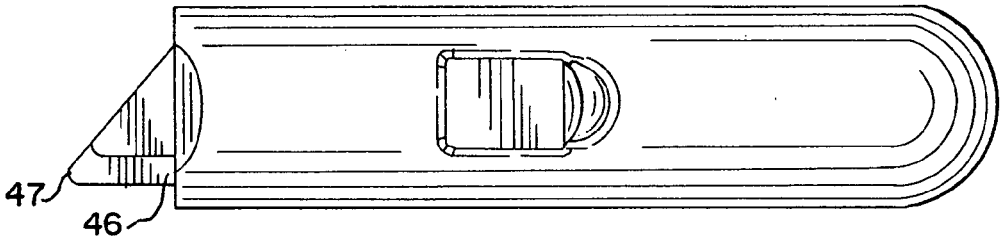
FIG. 3 is a plan view of the tilt-latch.

As shown in FIGS. 2–10, the tilt-latch 10 generally comprises a housing 42, a latch bolt 46, an actuator 48 and a spring 50. With the exception of the actuator 48, the tilt-latch components are similar to the components shown in U.S. Pat. No. 5,139,291, assigned to Ashland Products, Inc., the assignee of the present invention. As shown in FIGS. 1, 2 and 7, the housing 42 is adapted to be supported by the top rail 20. In a preferred embodiment, the housing 42 is designed to be flush-mounted in the top rail 20. It is understood, however, that the housing 42 could be designed to be supported in other ways by the top rail 20 such as a "top-mount" design. The latch bolt 46 is disposed within the housing 42. The actuator 48 is connected to the latch bolt 46 and is designed to retract the latch bolt 46 into the housing 42 against the biasing force of the spring 50. It is understood that in a preferred embodiment, the actuator 48 is a separate component of the tilt-latch 10 but, nevertheless, could be integrally connected, for example, to the latch bolt 46. In the most preferred embodiment of the invention, however, the separate actuator 48 is utilized.

Figure 8:
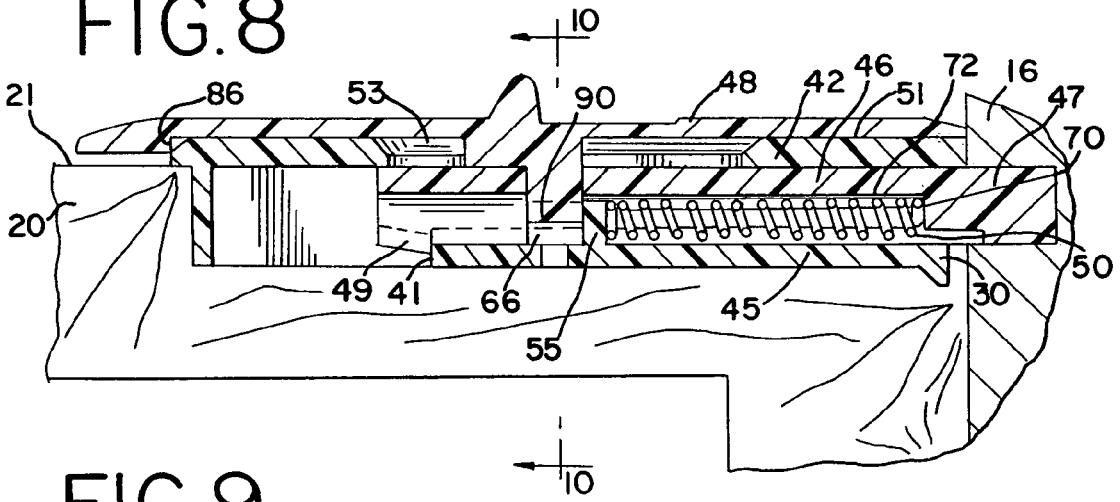
FIG. 8 is a cross-sectional view of the tilt-latch taken along lines 8—8 of FIG. 7.

As shown in FIG. 2, in a most preferred embodiment, the housing 42 generally has a box-type structure defining a chamber 43 therein. The housing 42 has a cover 51 having opposing longitudinal edges 52,54. Referring to FIGS. 2–5, a pair of sidewalls 56,58 depend from the cover 51, and in the preferred embodiment are spaced inward of the respective longitudinal edges 52,54. The housing 42 further has a bottom wall 45 (FIG. 8). If desired, the tilt-latch 10 could be designed wherein the housing 42 has an open bottom end with no bottom wall. The cover 51, sidewalls 56,58 and bottom wall 45 cooperate to form the chamber 43 within the housing 42. The housing 42 also has an outward end opening 44 in communication with the chamber 43. The housing 42 is preferably of a one-piece construction. The one-piece construction strengthens the housing 42 and simplifies assembly. The housing 42, however, could also be made from multiple pieces. In addition, while a box-type housing structure is preferred, the housing could also take other forms. For example, the housing 42 could not include the bottom wall 45 but instead include tabs to hold the latch bolt 46 in the housing 42. The spring 50 could be held any number of ways as known in the art. In a preferred embodiment of the invention, the housing is made from polymeric materials such as plastic using known injection molding processes. It is understood that any number of known plastic materials could be used. In a most preferred embodiment, the housing is made from nylon plastic. As shown in FIG. 8, the cover 51 of the housing 42 has an elongated opening 53.

Figure 4:
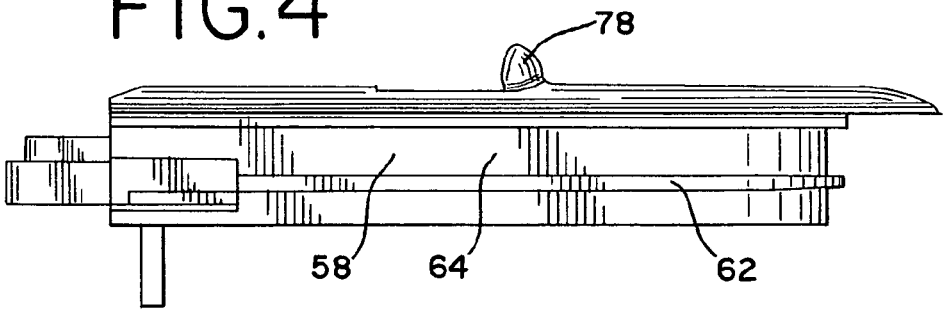
FIG. 4 is a side elevational view of the tilt-latch.
Figure 5:
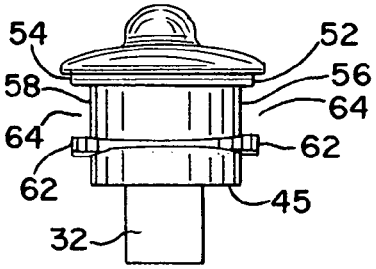
FIG. 5 is a rear end view of the tilt-latch.

As shown in FIGS. 2, 4 and 5, each of the sidewalls 56,58 has a sidewall rail 62 which cooperates with a respective one of the housing cover longitudinal edges 52,54, to form a longitudinal groove 64 adapted to cooperatively receive a respective one of the header rails 36,38. The sidewall rail 62 could be noncontinuous and comprise a number of spaced projections to form a noncontinuous groove with the cover 51. The housing cover longitudinal edges 52,54 could also be noncontinuous although this is normally not desired for cosmetic purposes. The sidewall rail 62 could also comprise one projection at a front portion of the sidewall and another projection on a rear portion of the sidewall to form the groove 64 with the cover 51. The sidewall rail 62 can also extend completely around the rear of the housing 42 to provide greater contact with the header rails 36,38. In a wood window application, the header rails 36,38 are routed to be thicker than header rails 36,38 in a vinyl window application to make the wood header rails sufficiently robust. Consequently, the groove 64 (FIG. 4) may be wider than the groove shown, for example, in U.S. Pat. No. 5,139,291.

Figure 12:
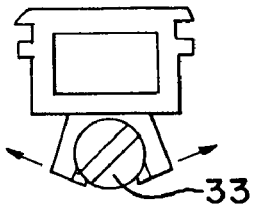
FIG. 12 is an end view of the tilt-latch showing a screw installed into the screw post.

As shown in FIG. 8, the housing 42 could include a depending tab 30 for engaging an inner surface formed in a respective one of the stiles 24,26 when installed in the sash window frame. The depending tab 66 is preferably a solid, inflexible tab to maintain the structural rigidity of the housing 42. The depending tab 66, however, could also be flexible. The housing 42 could also have a screw hole for fastening to the top rail 20 such as if the sash frame was solid. For example, a screw hole could be provided in the bottom wall 45 of the housing 42. FIGS. 2, 5, 11 and 12 show an alternative wherein the housing 42 has a depending screw post 32 typically used in a wood window application. The stile 24,26 is prepared accordingly to accommodate the screw post 32. As shown in FIG. 12, a screw 33 is then screwed through the post and into the stile 24,26 wherein the screw post 32 may split substantially down its center. It is understood that a different type of fastener could be used such as a nail, staple or staking fastener in place of the screw 33.

Figure 9:
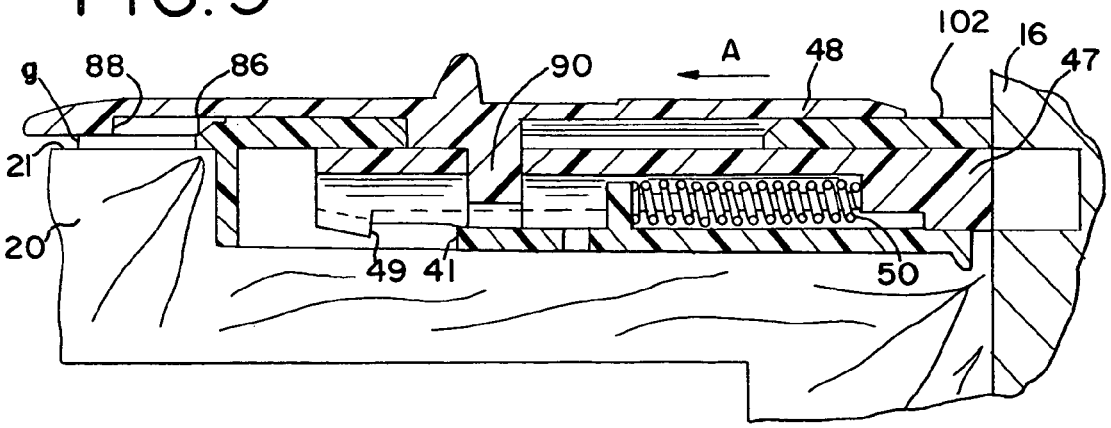
FIG. 9 is another cross-sectional view of the tilt-latch taken along lines 8—8 of FIG. 7 showing the tilt-latch actuator retracting a latch bolt of the tilt-latch.
Figure 10:
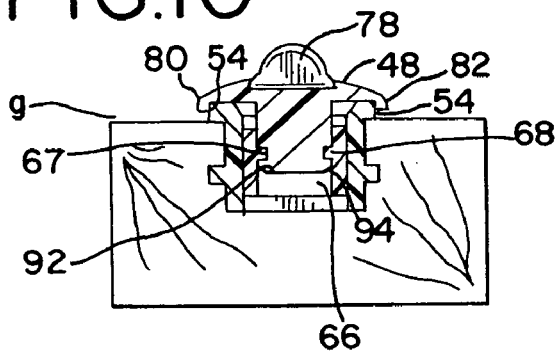
FIG. 10 is a cross-sectional view of the tilt-latch taken along lines 10—10 of FIG. 8.
Figure 11:
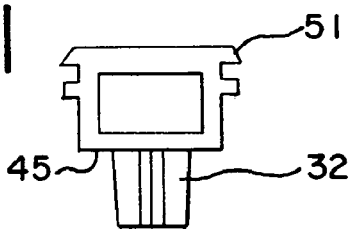
FIG. 11 is an end view of the tilt-latch showing a screw post.

As shown in FIGS. 2–4 and 8, the latch bolt 46 is disposed within the chamber 43 of the housing 42 and is adapted to slide within the housing 42. The latch bolt 46 has a nose 47 adapted for engaging a respective one of the guide rails 16. As shown in FIGS. 8 and 9, the latch bolt has a slot 66. As shown in FIG. 10, the slot has a pair of fingers 67,68 that extend into the slot 66. The slot 66 and fingers 67,68 cooperate with connecting structure on the actuator 48 as will be described in greater detail below. As shown in FIG. 8, the latch bolt 46 preferably has a spring wall 70 that is designed to engage or abut against one end of the spring 50. The latch bolt 46 has a pocket 72 that accommodates the spring 50. The spring 50 functions to bias the latch bolt 46 out of the housing 42. Preferably, as shown in FIG. 8, the spring 50 is positioned in the chamber 43 and within the pocket 72, and has one end positioned abutting the spring wall 70 and another end abutting an intermediate spring wall 55 of the housing 42 wherein the latch bolt 46 is biased through the outward end opening 44 of the housing 42. The housing 42 could have an opening cut into the bottom wall 45 that defines a stop surface 41 and the latch bolt 46 could have a hook 49 that catches on the stop surface to serve as a bolt stop, similar to the tilt-latch disclosed in U.S. Pat. No. 5,139,291. As with the housing 42, the latch bolt 46 is also preferably made from plastic although other materials are possible. In a most preferred embodiment, the latch bolt 46 is made from nylon plastic.

Figure 14:
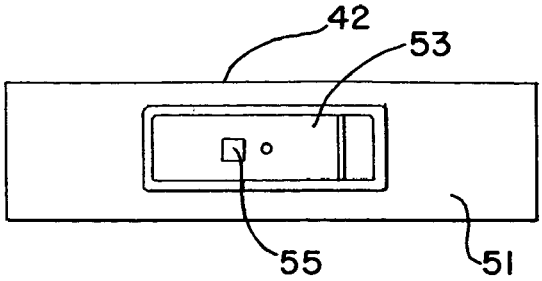
FIG. 14 is a plan view of the housing of the tilt-latch.
Figure 15:
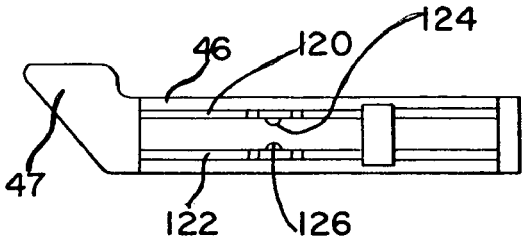
FIG. 15 is a bottom view of the latch bolt of the tilt-latch.
Figure 16:
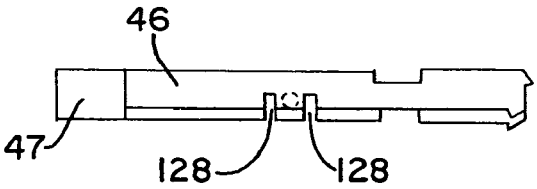
FIG. 16 is a side elevational view of the tilt-latch.
Figure 17A:
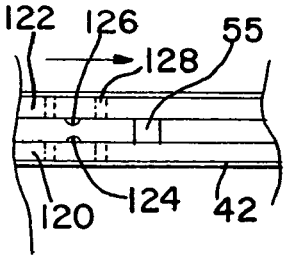
FIGS. 17*a*–17*c* are schematic views showing the latch bolt retracting into the housing and being maintained in a retracted position.
Figure 17B:
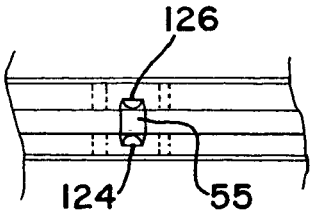
Figure 17C:
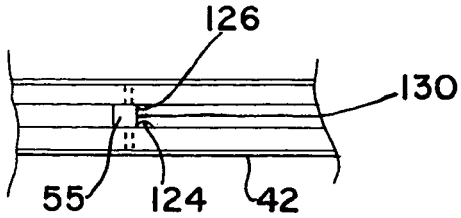

The housing 42 and latch bolt 46 are equipped with a cooperative mechanism to maintain the latch bolt 46 in a retracted position. FIG. 14 shows a plan view of the housing 42 wherein the intermediate spring wall 55 is shown through the elongated opening 53. The spring wall 55 is one inner wall of the housing 42. FIG. 15 shows an underside of the latch bolt 46. The latch bolt 46 has a pair of rails 120,122. Each rail 120,122 has a protrusion 124,126 arranged inwardly and in opposing relation along the rails 120,122. Each protrusion 124,126 has a slit 128 formed in the rail 120,122 on each side of the protrusion 124,126. The protrusion 124,126 is resilient and the slits 128 improve the flexibility of the protrusions 124,126. The protrusions 124, 126 cooperate with the inner wall, or spring wall 55 to maintain the latch bolt 46 in a retracted position when the latch bolt 46 is retracted into the housing 42. This feature will be described in greater detail below.

It is noted that in a preferred embodiment of the invention, the spring 50 is a coil spring. It is understood, however, that other biasing members could also be used in place of the spring 50. For example, other types of springs can be used such as z-springs and leaf springs although coil springs are preferred. Rubber or polymeric resilient members could also be used. In addition, resilient plastic member(s) could be integrally attached to the latch bolt 46 to bias the latch bolt 46 out of the housing 42. In sum, any structure could be used that will cause the latch bolt 46 to move back and forth. It is further understood that a biasing means is not required. The tilt-latch could be adapted for manual retraction and extension of the latch bolt 46.

Figure 6:
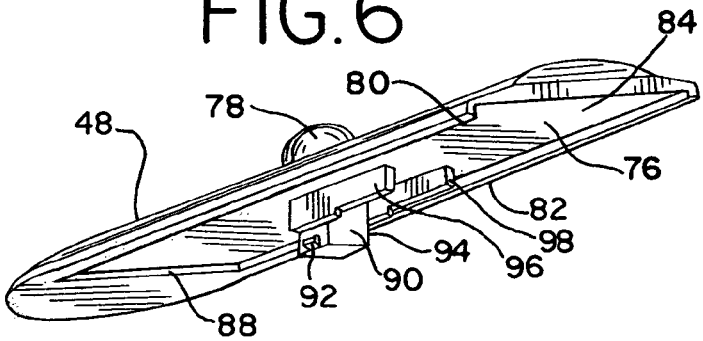
FIG. 6 is a perspective view of the tilt-latch actuator showing an underside of the actuator.

As shown in FIGS. 6, 8 and 9, the actuator 48 is generally an elongated body having a top surface 74 and an underside surface 76. A control button 78 extends from the top surface 74 and is shaped to be comfortably engaged by an operator's finger. The actuator 48 has opposed longitudinal flanges 80,82 that depend from the top surface 74. As discussed in greater detail below, the depending longitudinal flanges 80,82 are adapted to slide along the peripheral edges 52,54 of the housing cover 51 when the latch bolt 46 is retracted into the housing. The underside surface 76 has a recessed portion 84 that accommodates the cover 51 of the housing 42 when connected to the latch bolt 46. In one preferred embodiment, the cover 51 is rectangular, and the recessed portion 84 is sized to correspond to the cover 51. As shown in FIG. 8, the cover 51 has a rear transverse edge 86. The underside surface 76 has an actuator rear transverse edge 88 (FIGS. 6 and 9) that engages the rear transverse edge 86 of the housing when the actuator 48 is connected to the latch bolt 46. The actuator 48 generally has a raised cross-sectional shape to accommodate the housing structure it fits over.

As further shown in FIGS. 6, 8 and 9, the actuator 48 has a post 90 extending downwardly from the underside surface 76. The post 90 has a pair of fingers 92,94 extending from side surfaces of the post 90. A pair of ridges 96,98 depend from the underside surface 76 and extend from opposite sides of the post 90. The ridges 96,98 will rest on a top surface of the latch bolt 46.

The tilt-latch 10 is easily preassembled by first inserting the spring 50 and latch bolt 46 into housing 42 through the elongated opening 53. The spring 50 is positioned within the pocket 72 and has one end against the intermediate spring wall 55 and the other end against the spring wall 70 of the latch bolt 46 to bias the latch bolt 46 outwardly through the outward end opening 44. The actuator 48 is then placed over the cover 51 of the housing 42 wherein the post 90 passes through the elongated opening 53 and is inserted into the slot 66 of the latch bolt 46. The post 90 is snapped into the slot 66 wherein the tabs 92,94 slide past the fingers 67,68. The tabs 92,94 engage underside surfaces of the fingers 67,68 respectively (FIG. 10). The actuator 48 is then connected to the latch bolt 46. The ridges 96,98 rest on a top surface of the latch bolt 46 and help prevent any rocking of the actuator 48. As shown in FIGS. 2 and 7, the actuator 48 is sized to be positioned over the entire cover 51 of the housing 48. The flanges 80,82 are positioned over the longitudinal peripheral edges 52,54 of the cover. The recessed portion 84 receives the cover 51 wherein the actuator 48 rests adjacent the top surface 21 of the top rail 20. A small gap may be maintained between the flanges 80,82 and the top surface 21 of the top rail 20. The actuator 48 also has a rounded rear portion 100 that extends past the rear transverse edge 86 of the cover 51. Thus, when the latch bolt 46 is in a first position biased through the outward end opening 44, the actuator 48 blankets or shrouds the cover 51 where one can only see the actuator 48. As the actuator 48 is preferably made from zinc, one viewing the window sash from either inside or outside of a room sees an aesthetically pleasing metal tilt-latch, and is not aware the remaining portions of the tilt-latch are made from plastic.

After preassembly, the tilt-latch 10 can then be installed into the sash window 12. Preferably, the tilt-latch 10 is inserted from the side into a respective one of the header slots 34, such that the pair of longitudinal grooves 64 cooperatively receive a respective pair of the header rails 36,38. The tilt-latch 10 is inserted until the depending tab 66 has engaged the inner surface of a respective one of the stiles 24,26. Alternatively, the longitudinal groove could be formed with resilient tabs/projections wherein the tilt-latch 10 could be installed by snapping the latch in from the top of the top rail 20. In addition, the entire side wall rail 62 could be beveled to allow snap insertion from the top of the top rail 20. Regardless of the specific method of insertion into the top rail 20, once installed, the longitudinal grooves 64 cooperatively receive the header rails 36,38 and support the tilt-latch in the top rail 20. In addition, as alternatively shown in FIGS. 11 and 12, the screw post 32 could be used instead of the tab 30. A screw 33 would be screwed into the post 32 and into a respective one of the stiles 24, 26. It is further understood that the housing 42/spring 5/latch bolt 46 subassembly could be pre-assembled first and installed into the top rail and then the actuator 48 could subsequently be connected to the latch bolt 46.

FIGS. 7–9 show the tilt-latch 10 installed in the top rail 20. An underside of the cover 51 rests on the top surfaced 21 of the top rail 20. The actuator 48 blankets the cover 51 and rests above the top surface 21 of the top rail 20. As shown in FIGS. 9 and 10, a gap "g" is maintained between the flanges 80,82 of the top surface 21 of the top rail 20. The actuator 48 extends from a leading edge surface of the stile 24,26 to an area past the housing 42. To actuate the tilt-latch 10, an operator's finger engages the control button 78 and pulls back on the actuator 48 wherein the actuator 48 moves in the direction of arrow A. As the actuator 48 is connected to the latch bolt 46, the latch bolt 46 is retracted into the housing 42 as shown in FIG. 9. When the actuator 48 retracts the latch bolt 46 into the housing 42, the flanges 80,82 of the actuator 48 slide along the peripheral edges 52,54 of the cover 51. As shown in FIG. 9, the gap g is maintained even when the latch bolt is retracted thereby preventing any scraping damage of the top surface 21 of the top rail. As further shown in FIGS. 7–9, the housing 42 is adapted for substantially flush installation in the top rail 20 wherein the cover 51 is positioned on the top surface 21 of the top rail 20. When the actuator 48 retracts the latch bolt 46, the actuator 48 slides along the cover 51 exposing a front segment 102 of the cover 51 (FIG. 9). The actuator 48 slides along the top surface 21 of the top rail 20, but does not contact the top surface 21. By retracting the latch bolts 46 of each respective tilt-latch 10 simultaneously, the sash window 12 can be tilted from the master frame.

As shown in FIGS. 14–17, the housing 42 and latch bolt 46 have a cooperative mechanism to maintain the latch bolt 46 in a retracted position. As discussed, the latch bolt has an extended position (FIG. 8) wherein the spring 50 biases the latch bolt 46 through the outward end opening 44. FIG. 17*a* shows a schematic view of this latch bolt 46 wherein the protrusions 124,126 are spaced from the inner wall or spring wall 55 of the housing 42. When the latch bolt 46 is retracted into the housing 42, the protrusions 124,126 advance towards the inner wall 55. As shown in FIG. 17*b*, the protrusions 124,126 flex around side walls of the inner wall until they pass the inner wall 55 as shown in FIG. 17*c*. The resilient protrusions 124,126 snap back and engage a back surface 130 of the inner wall 55. This engagement maintains the latch bolt 46 in a retracted position even against the biasing force of the spring 50. To return the latch bolt 46 to its extended position, an operator must engage the actuator 48 to move the latch bolt 46 to the extended position wherein the protrusions 124,126 pass back over the inner wall 55. In certain applications, operators prefer to be able to maintain the latch bolts 46 in a retracted position. It is understood that the protrusion/wall structure could be reversed between the housing 42 and the latch bolt 46.

Figure 13:
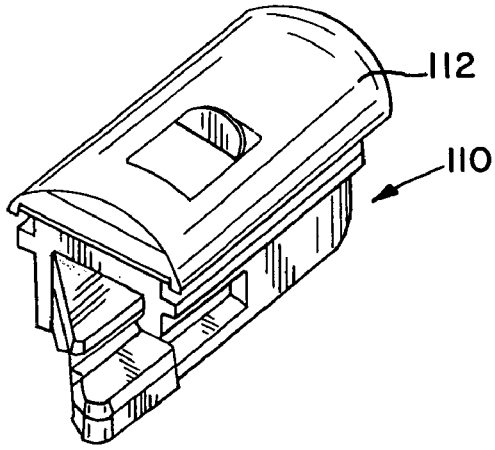
FIG. 13 is a perspective view of an alternative tilt-latch of the present invention.

FIG. 13 shows an alternative embodiment of the tilt-latch 10 of the present invention wherein an actuator 110 is shorter in length to correspond in size to a smaller cover 112. This type shorter type of tilt-latch, shown with a different actuator, is disclosed in application Ser. No. 09/121,289.

The design and structure of the tilt-latch 10 of the present invention provide a number of advantages. As discussed, in a most preferred embodiment, the housing 42 and latch bolt 46 are made from nylon plastic and the actuator 48 is made from zinc. Because the actuator 48 covers the entire housing 42, when installed in a sash window, only the actuator 48 is viewable. The tilt-latch structure below the actuator 48 is hidden from view under the actuator 48. This feature makes the tilt-latch 10 particularly suitable for installation in a wood window, or simulated wood window where metal hardware is aesthetically preferred. While obtaining these aesthetic benefits, the substantial remainder of the tilt-latch 10 (e.g. housing 42 and latch bolt 46) can be made from nylon plastic. This material is less expensive, saving on material costs. The operation between the latch bolt 46 and housing 42 is also smother and quieter than if all zinc materials were used. The plastic latch bolt 46 also minimizes the risk of damaging sash frame components including trim, stiles, or the sash frame guide rails when the latch bolt nose 47 engages outer surfaces of the guide rails such as when the sash window 12 is pivoted to a closed position. In addition, with the actuator sized to completely cover the housing 42, additional housing structures are possible. For example, a housing could be provided without a cover 51 if desired. Also, a generic housing 42/latch bolt 46 subassembly could be provided with actuators 48 of several different colors to match a variety of different wood windows. The actuator 48 could also be plated if desired. While the most preferred embodiment contemplates a zinc actuator, it is understood that the actuator 48 could also be made from plastic. It is further understood that regardless of the materials used to construct the tilt-latch components, the tilt-latch 10 can be used in solid wood windows, simulated wood windows or even traditional vinyl windows having PVC extrusions, with a zinc actuator or plastic actuator.

While the specific embodiments have been illustrated and described, numerous modifications come to mind without significantly departing from the spirit of the invention and the scope of protection is only limited by the scope of the accompanying claims.

We claim:

1. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a cover, the cover having opposed longitudinal peripheral edges;

a latch bolt disposed within the housing and having a nose adapted for engaging a respective one of the guide rails; and, an actuator connected to the latch bolt and sized to be positioned over the entire cover, the actuator having opposed depending flanges, the flanges being positioned over the peripheral edges of the cover wherein the flanges slide along the peripheral edges when the latch bolt is retracted into the housing.

2. The tilt-latch of claim 1 further comprising means for biasing the latch bolt through the outward end opening.

3. The tilt-latch of claim 1 wherein the housing is adapted for substantially flush installation in the top rail wherein the cover is positioned on the top rail, wherein the actuator slides along the cover when retracting the latch bolt into the housing exposing a front segment of the cover.

4. The tilt-latch of claim 1 wherein the latch bolt has a slot and the actuator has a post, the post being received by the slot.

5. The tilt-latch of claim 4 wherein latch bolt has a finger extending into the slot and the actuator post has a tab, the tab engaging an underside of the finger.

6. The tilt-latch of claim 4 wherein the cover has an elongated opening wherein the post extends through the elongated opening and into the slot.

7. The tilt-latch of claim 4 wherein the actuator has a pair of ridges depending from an underside of the actuator and extending from the post.

8. The tilt-latch of claim 1 wherein the actuator has an underside surface, the underside surface having a recessed portion accommodating the cover of the housing.

9. The tilt-latch of claim 8 wherein the actuator is rectangular, the recessed portion being rectangular and corresponding in size to the cover.

10. The tilt-latch of claim 8 wherein the cover has a rear transverse edge that engages a rear transverse edge defined by the recessed portion of the actuator.

11. The tilt-latch of claim 1 wherein the actuator has a control button.

12. The tilt-larch of claim 1 wherein the housing is adapted for substantially flush installation in the top rail and wherein the actuator slides along a top surface of the top rail when the latch bolt is retracted into the housing.

13. The tilt-latch of claim 1 wherein the actuator is made of metal.

14. The tilt-latch of claim 13 wherein the actuator is made of zinc.

15. The tilt-latch of claim 1 wherein the housing and latch bolt are made from plastic.

16. The tilt-latch of claim 1 wherein the biasing means comprises a spring.

17. The tilt-larch of claim 1 wherein the top rail has opposed header slots and the housing includes means for supporting the housing in the header slots.

18. The tilt-latch of claim 17 wherein each header slot defines a pair of header rails and the housing has sidewalls wherein the means for supporting comprises a longitudinal groove on each sidewall, the longitudinal groove receiving the header rail to support the housing in the top rail.

19. The tilt-latch of claim 1 wherein the housing further includes a depending tab engaging one of the stiles.

20. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a plastic housing adapted to be supported by the top rail, the housing having an outward end opening;

a plastic latch bolt disposed within the housing and having a nose adapted for engaging a respective one of the guide rails;

means for biasing the latch bolt through the outward end opening; and, a metal actuator connected to the latch bolt.

21. The tilt-latch of claim 20 wherein the actuator is made of zinc.

22. The tilt-latch of claim 20 wherein the housing has a cover and the actuator is sized to be positioned over the entire cover.

23. The tilt-latch of claim 22 wherein the cover has opposed longitudinal peripheral edges and the actuator has opposed depending longitudinal flanges, the flanges being positioned over the peripheral edges.

24. The tilt-latch of claim 23 wherein the flanges slide along the peripheral edges when the latch bolt is retracted into the housing.

25. The tilt-latch of claim 22 wherein the actuator slides along the cover when retracting the latch bolt into the housing exposing a front segment of the cover.

26. The tilt-latch of claim 20 wherein the latch bolt has a slot and the actuator has a post, the post being received by the slot.

27. The tilt-latch of claim 26 wherein latch bolt has a finger extending into the slot and the actuator post has a tab, the tab engaging an underside of the finger.

28. The tilt-latch of claim 26 wherein the housing has a cover having an elongated opening wherein the post extends through the elongated opening and into the slot.

29. The tilt-latch of claim 20 wherein the actuator has a control button.

30. An actuator for a tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprises a housing adapted to be supported by the top rail, the housing having an outward end opening and a cover, and a latch bolt disposed within the housing and having a nose adapted for engaging a respective one of the guide rails, the actuator comprising:

an elongated body connected to the larch bolt and sized to be positioned over the entire cover, wherein the housing is adapted for substantially flush installation in the top rail, and wherein the cover is adapted to be positioned on the top rail, and wherein the actuator is adapted to slide along the cover when retracting the latch bolt into the housing exposing a front segment of the cover.

31. The tilt-latch actuator of claim 30 wherein the cover is adapted to have opposed longitudinal peripheral edges and the actuator has opposed depending longitudinal flanges, the flanges adapted to be positioned over the peripheral edges.

32. The tilt-latch actuator of claim 31 wherein the flanges are adapted to slide along the peripheral edges when the latch bolt is retracted into the housing.

33. The tilt-latch actuator of claim 30 wherein the latch bolt is adapted to have a slot and the actuator has a post, the post adapted to be received by the slot.

34. The tilt-latch actuator of claim 30 wherein the elongated body is made of zinc.

35. A tilt-latch for a sash window disposed within opposed guide rails on a master frame, the sash window comprises a top rail, a base and two stiles connected together at their extremities, the top rail having opposed header slots, the tilt-latch adapted for releaseably securing the sash window to the master frame, the tilt-latch comprising:

a plastic housing having means for supporting the housing in the header slot, the housing having an outward end opening, the housing further having a cover and a pair of sidewalls depending from the cover, the cover having opposed longitudinal peripheral edges and an elongated opening positioned within the peripheral edges;

a plastic latch bolt disposed within the housing and having a nose adapted for engaging a respective one of the guide rails, the latch bolt having a slot, the latch bolt further having a spring wall;

a spring having one end positioned abutting the spring wall and another end abutting the housing wherein the latch bolt is biased through the outward end opening; and, a zinc actuator having a post that is received by the slot wherein the actuator is connected to the latch bolt, the actuator having a pair of opposed depending longitudinal flanges, the actuator being sized to be positioned over the entire the cover and wherein the flanges are positioned over the longitudinal peripheral edges of the cover and wherein the actuator slides along the cover when retracting the latch bolt into the housing.

36. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and an inner wall;

a latch bolt disposed within the housing and having a nose adapted for engaging a respective one of the guide rails, the latch bolt further having a protrusion; and, wherein the latch bolt has an extended position wherein the nose of the latch bolt extends through the outward end opening and wherein the protrusion is spaced from the wall, and wherein the latch bolt has a retracted position wherein the protrusion engages the wall to maintain the latch bolt in the retracted position.

37. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a cover;

a latch bolt disposed within the housing and having a nose adapted for engaging a respective one of the guide rails; and, an actuator connected to the latch bolt and sized to be positioned over the entire cover, wherein the housing is adapted for substantially flush installation in the top rail wherein the cover is positioned on the top rail, wherein the actuator slides along the cover when retracting the latch bolt into the housing exposing a front segment of the cover.

38. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to be supported by the top rail, the housing having an outward end opening and a cover;

a latch bolt disposed within the housing and having a nose adapted for engaging a respective one of the guide rails, the latch bolt further having a slot; and, an actuator positioned over the entire cover, the actuator having a post, the post being received by the slot to connect the latch bolt and the actuator.

39. The tilt-latch of claim 38 wherein latch bolt has a finger extending into the slot and the actuator post has a tab, the tab engaging an underside of the finger.

40. The tilt-latch of claim 38 wherein the cover has an elongated opening wherein the post extends through the elongated opening and into the slot.

41. The tilt-latch of claim 38 wherein the actuator has a pair of ridges depending from an underside of the actuator and extending from the post.

42. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a housing adapted to for substantially flush installation in the top rail, the housing having an outward end opening and a cover;

a latch bolt disposed within the housing and having a nose adapted for engaging a respective one of the guide rails; and, an actuator connected to the latch bolt and sized to be positioned over the entire cover, wherein the actuator slides along a top surface of the top rail when the latch bolt is retracted into the housing.

43. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a plastic housing adapted to be supported by the top rail, the housing having an outward end opening and a cover with opposed longitudinal peripheral edges;

a plastic latch bolt disposed within the housing and having a nose adapted for engaging a respective one of the guide rails; and, a metal actuator connected to the latch bolt, wherein the actuator is sized to be positioned over the entire cover, and wherein the actuator has opposed depending longitudinal flanges, the flanges being positioned over the peripheral edges of the cover whereby the flanges slide along the peripheral edges when the latch bolt is retracted into the housing.

44. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a plastic housing adapted to be supported by the top rail, the housing having an outward end opening and a cover with opposed longitudinal peripheral edges;

a plastic latch bolt disposed within the housing and having a nose adapted for engaging a respective one of the guide rails; and, a metal actuator connected to the latch bolt, wherein the actuator is sized to be positioned over the entire cover, and wherein the actuator has opposed depending longitudinal flanges, the flanges being positioned over the peripheral edges of the cover whereby the actuator slides along the cover when retracting the latch bolt into the housing exposing a front segment of the cover.

45. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a plastic housing adapted to be supported by the top rail, the housing having an outward end opening;

a plastic latch bolt disposed within the housing and having a nose adapted for engaging a respective one of the guide rails, the latch bolt further having a slot and a finger extending into the slot; and a metal actuator connected to the latch bolt, the actuator having a post, the post being received by the slot, the post having a tab, the tab engaging an underside of the finger.

46. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a plastic housing adapted to be supported by the top rail, the housing having an outward end opening and a cover, the cover having an elongated opening;

a plastic latch bolt disposed within the housing and having a nose adapted for engaging a respective one of the guide rails, the latch bolt further having a slot; and a metal actuator connected to the latch bolt, the actuator having a post wherein the post extends through the elongated opening and into the slot.

47. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a plastic housing adapted to be supported by the top rail, the housing having an outward end opening;

a plastic latch bolt disposed within the housing and having a nose adapted for engaging a respective one of the guide rails; and a metal actuator connected to the latch bolt, the actuator having a control button.

48. An actuator for a tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprises a housing adapted to be supported by the top rail, the housing having an outward end opening and a cover having opposed longitudinal peripheral edges, and a latch bolt disposed within the housing and having a nose adapted for engaging a respective one of the guide rails, the actuator comprising:

an elongated body connected to the latch bolt and sized to be positioned over the entire cover, wherein the actuator has opposed depending longitudinal flanges, the flanges adapted to be positioned over the peripheral edges and slide along the peripheral edges when the latch bolt is retracted into the housing.

49. An actuator for a tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprises a housing adapted to be supported by the top rail and for substantially flush installation in the top rail, the housing having an outward end opening and a cover wherein the cover is adapted to be positioned on the top rail, and a latch bolt disposed within the housing and having a nose adapted for engaging a respective one of the guide rails, the actuator comprising:

an elongated body connected to the latch bolt and sized to be positioned over the entire cover, wherein the actuator is adapted to slide along the cover when retracting the latch bolt into the housing exposing a front segment of the cover.

50. An actuator for a tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprises a housing adapted to be supported by the top rail, the housing having an outward end opening and a cover, and a latch bolt disposed within the housing and having a slot and a nose adapted for engaging a respective one of the guide rails, the actuator comprising:

an elongated body connected to the latch bolt and sized to be positioned over the entire cover, the body having a post adapted to be received by the slot in the latch bolt.

51. A tilt-latch for a sash window disposed within opposed guide rails on a master frame, the sash window comprises a top rail, a base and two stiles connected together at their extremities, the tilt-latch adapted for releaseably securing the sash window to the master frame, the tilt-latch comprising:

a plastic housing adapted to be supported by the top rail, the housing having an outward end opening and a cover;

a plastic latch bolt disposed within the housing and having a nose adapted for engaging a respective one of the guide rails; and, a metal actuator connected to the latch bolt, wherein the actuator is sized to be positioned over the entire cover.

* * * * *